US005813207A

United States Patent [19]

König et al.

[11] Patent Number: 5,813,207

[45] Date of Patent: Sep. 29, 1998

[54] CENTRIFUGAL SPINNING PROCESS AND DEVICE

[76] Inventors: Reinhard König; Friedrich König, both of Mahlbergweg 5, 76275 Ettlingen, Germany; Georg König, 250 Fitch St., New Haven, Conn. 06515

[21] Appl. No.: 552,634

[22] Filed: Nov. 3, 1995

Related U.S. Application Data

[63] Continuation of PCT/EP94/01415 May 4, 1994.

[30] Foreign Application Priority Data

May 4, 1993 [WO] WIPO ..... PCT/EP93/01078

[51] Int. Cl.[6] ..... D01H 1/08; D01H 7/74

[52] U.S. Cl. ..... 57/75; 57/77; 57/308; 57/312

[58] Field of Search ..... 57/76, 77, 308, 57/312

[56] References Cited

U.S. PATENT DOCUMENTS

| | | | |
|---|---|---|---|
| 1,642,290 | 9/1927 | Bassett et al. | 57/76 |
| 3,217,483 | 11/1965 | Kato et al. | 57/76 |
| 3,314,223 | 4/1967 | Bobkowicz | 57/76 |
| 4,080,779 | 3/1978 | Freeman et al. | 57/312 |

FOREIGN PATENT DOCUMENTS

| | | | |
|---|---|---|---|
| 494421 | 7/1950 | Belgium | 57/76 |
| 4400999 | 7/1995 | Germany . | |

*Primary Examiner*—William Stryjewski
*Attorney, Agent, or Firm*—Horst M. Kasper

[57] ABSTRACT

A centrifugal pot spinning process for spinning yarn of classical character is provided in which either in one stage a fully twisted yarn or in a first stage a partially twisted yarn is spun in a centrifuge (6) and removed from it and, in the case of the partially twisted yarn, the remaining twist is imparted to the yarn in a second stage upon removal while being wound up. A centrifuge (6), a drawing frame (1), a piecing mechanism (2), and a traversing thread guide tube (4) are used. The centrifuge (6) rotates in a space (7) under reduced pressure (pu). Normal air pressure (pn) prevails inside the centrifuge (6) and spinning is carried out under normal air pressure (pn) inside the centrifuge. The reduced pressure (pu) is adjusted in such a way that, during rotation of the centrifuge (6), essentially only the bearing friction of the centrifuge still occurs but the air friction of the outer wall of the centrifuge (6, 35, 45, 53) against the housing (5') is largely suppressed. A vacuum centrifuge (5) is positioned so as to pivot inside the housing (5'). The space (7) between the centrifuge (6) and the housing (5') can be placed under variable reduced pressure (pu). The reduced pressure is adjustable in such a way that, during rotation, essentially only the bearing friction of the centrifuge still occurs but the air friction of the outer wall of the centrifuge is largely suppressed.

29 Claims, 8 Drawing Sheets

CENTRIFUGAL SPINNING PROCESS AND DEVICE

CROSS-REFERENCE TO RELATED APPLICATIONS

This application is a continuation-in-part application of another international application filed under the Patent Cooperation Treaty on May 4, 1994, bearing Application No. PCT/EP94/01415, and listing the United States as a designated and/or elected country. The entire disclosure of this latter application, including the drawings thereof, is hereby incorporated in this application as if fully set forth herein.

BACKGROUND OF THE INVENTION

1. Field of the Invention

The present invention relates to a centrifugal pot spinning process for spinning yarn of classical character, where a fully twisted yarn is spun in one stage or in two stages, as well as to a device for this purpose.

2. Brief Description of the Background of the Invention Including Prior Art

It is known that, in addition to the ring spinning and rotor spinning processes, yarn can be spun in a centrifuge by means of a drawing frame and a traversing thread guide. Two methods are used for this:

In the first method, a fully twisted yarn is laid down in a centrifuge, thereby giving rise to the problem of removing the wound yarn from the centrifuge. For this purpose, a mandrel is inserted into the still rotating centrifuge, resulting in a rewinding process, so that at the end of the operation, the yarn is located on the mandrel, from which in another step, it has to be rewound on a marketable makeup. A problem encountered with this method is thread breakage, because it is necessary to seek and find the end of the yarn in the rotating centrifuge, something which can only be done with considerable effort.

The need for emptying the centrifuge is circumvented in two-stage spinning. In the first stage, spinning is carried out in the centrifuge with a partial twisting. Once the centrifuge is filled, the yarn is withdrawn and wound in a second stage, whereby the remaining twist is imparted to the yarn. However, in stagewise spinning, too, thread breakage can only be eliminated with great difficulty.

Although high spindle rotational speeds and thus a high output can be attained with the centrifugal pot spinning process, it has not been possible up until now to make the process economical owing to the disproportionately high input of energy and capital. In order to diminish capital input, GB-A-918,963 describes the installation of the centrifuge in a stationary bucket so as to reduce aerodynamic losses. However, this method results in just a slight improvement, because encasing the centrifuge only manages to prevent the air vortex from dissipating. Also a slight lowering of the pressure, such as has been suggested, for example, in DE-A-21 03 717, has but little effect, since the air resistance of a rotating body does not decrease linearly with decreasing pressure but instead the air resistance decreases according to a root function.

Furthermore, it is not certain that the solution mentioned in GB-A-918,963 will work, because the spun material is withdrawn in the second stage through a stationary thread guide. As a result, the "false twist effect at the outlet nozzle," well-known from rotor spinning, occurs with a negative effect for the true twist; even the smallest disruptions in this system lead to winding around the thread guide tube and thus to a serious disruption of the spinning process.

SUMMARY OF THE INVENTION

1. Purposes of the Invention

The invention has the objective of creating a centrifugal pot spinning process of the kind mentioned, which operates with a low input of capital and energy.

For this purpose, the invention pursues the goal of producing a ring-yarn-like yarn of high quality at a lower cost and with lower energy input than is possible with state-of-the-art ring and rotor spindles.

These and other objects and advantages of the present invention will become evident from the description which follows.

2. Brief Description of the Invention

According to the invention, the objective is achieved by a centrifugal pot spinning process for spinning yarn of classical character in which either in one stage a fully twisted yarn or in a first stage a partially twisted yarn is spun in a centrifuge and removed from it and, in the case of the partially twisted yarn, the remaining twist is imparted to the yarn in a second stage upon removal while being wound up; a centrifuge, a drawing frame, a piecing mechanism, and a traversing thread guide tube in the centrifuge are used, whereby, in accordance with the invention, the centrifuge rotates in a space under reduced pressure, whereas normal air pressure prevails inside of the centrifuge and spinning is carried out inside of the centrifuge under normal air pressure, whereby the reduced pressure is set in such a way that, during rotation of the centrifuge, essentially only the bearing friction of the centrifuge still occurs but the air friction of the outer wall of the centrifuge is largely suppressed. The space between the preferably bottle-shaped centrifuge and a surrounding housing is sealed off with respect to the surroundings and placed under reduced pressure. It is advantageous to maintain the vacuum by continuous pumping in order to compensate for leaks. The seal is located at a place that is at a small distance from the axis of rotation of the centrifuge, that is, preferably at its neck.

A vacuum centrifugal pot spinning device is characterized in that the centrifuge is positioned so as to rotate inside of a housing and the internal space between the centrifuge and the housing can be placed under reduced pressure, whereas normal air pressure prevails inside of the centrifuge, the reduced pressure being adjustable in such a way that, during rotation of the centrifuge, essentially only the bearing friction of the centrifuge still occurs but the air friction against the housing is largely suppressed. It is advantageous for the centrifuge to be designed bottle-like or bottle-shaped with a centrically narrow neck. As a matter of principle, the housing and/or the centrifuge can consist of at least two parts that can be separated, whereby one part of the centrifuge is mounted axially so as to pivot in one part of the housing and the other part is mounted axially so as to pivot in the other part of the housing.

The present invention provides for a centrifugal pot spinning process for spinning yarn of classical character. A centrifuge is placed in a container. A pressure (pu) is reduced in the container. Standard ambient air pressure is maintained inside the centrifuge. The centrifuge is rotated in the container under reduced pressure (pu), while standard ambient air pressure (pn) prevails inside the centrifuge. Yarn is spun in the centrifuge under standard ambient air pressure (pn). The reduced pressure (pu) in the container is adjusted during rotation of the centrifuge in such a way that the air friction of the outer wall of the centrifuge is largely suppressed.

A fully twisted yarn can be spun in one stage.

A rotational speed can be dropped considerably below a nominal rotational speed after the centrifuge is filled with spun yarn. The reduced pressure (pu) can be relieved. The wound yarn can be removed with the help of a doffer.

The rotational speed can be dropped to about 1/10 of the nominal rotational speed.

A partially twisted yarn can be spun in the centrifuge in a first stage. The partially twisted yarn can be removed from the centrifuge. A remaining twist can be imparted in a second stage upon removal while being wound by using the centrifuge, a drawing frame, a piecing mechanism, and a traversing thread guide tube in connection with the centrifuge.

Only a bearing friction can be left as an essential friction of the centrifuge during rotation.

The air can be sucked off for a starting the spinning. The air can be sucked off immediately above the piecing mechanism. Spinning can be started automatically. A suction of air can be stopped as soon as the yarn being formed has reached the wall of the centrifuge.

The running of the centrifuge disposed in a housing can be stopped. The wound yarn situated in the interior of the centrifuge can be shrunk. The centrifuge can be taken out of the housing. The centrifuge can be set in rotation outside of the housing, so that the wound yarn can open once again and be further processed.

About 90 percent of the twist to the yarn can be imparted in a first stage and the remaining twist can be imparted in a second stage.

The spinning can be performed from a can. A false twist can be imparted to the sliver between an outlet of the can and an inlet of a drawing frame by means of a false-twist mechanism.

The sliver can be divided after the false-twist mechanism and can be fed to two drawing frames.

A housing and a centrifuge rotating in it under vacuum can each consist of at least two parts and can telescope into each other. The centrifuge parts can have different expansions. The following steps can be performed in order to fit the parts of the centrifuge in a force-locking manner. The centrifuge can be accelerated to an intermediate rotational speed that is chosen to be so high that the two parts of the centrifuge are compressed against each other in an air-tight manner owing to their different expansions. The compression can be chosen to be so high that it is accommodated by the axial forces caused by the subsequently applied reduced pressure (pu). The centrifuge can subsequently by accelerated to the operating rotational speed.

The vacuum centrifugal pot spinning process and the vacuum centrifugal pot spinning device entail the striking advantage that the specific capital and energy requirement relative to a yarn of the same strength and fineness lies below that of known ring and rotor spinning. A sufficiently simple spinning device can be constructed with the vacuum centrifugal pot spinning device, wherein the rotational speed is governed only by the strength of the centrifuge, without the energy required for operation of the device becoming too high. Rotational speeds up to 80,000 rpm and more can be attained here, so that the drawing frame can be run at much higher output speeds. For this reason, it is possible to spin with a specifically lower energy requirement than is possible for ring and rotor spinning devices. The inventor has realized that the aerodynamic losses of a centrifuge rotating in air can only be reduced to a sufficient extent if the pressure still prevailing around the centrifuge is about 5% lower than the normal air pressure. Optimal results are achieved if the values lie far below this limit. However, this calls for a perfect seal and an increased pumping capacity.

In the case of pure centrifugal pot spinning, thread breaks during operation do not pose a problem; they can be corrected during rewinding. In the case of two-stage spinning, it is necessary to seek and find the end of the thread in the still rotating centrifuge. Such thread finding is the subject matter of the applicant's German Patent Application P 4400999.2.

Owing to the largest possible vacuum under which the centrifuge is placed and the high rotational speed of the centrifuge thus possible, the output performance of the drawing frame increases dramatically, for which reason expensive high-draft drawing frames can be used in a practical manner, thereby making it possible to spin from the can without a flyer.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

In the accompanying drawings, in which are shown several of the various possible embodiments of the present invention.

DESCRIPTION OF INVENTION AND PREFERRED EMBODIMENT

Figure 1:
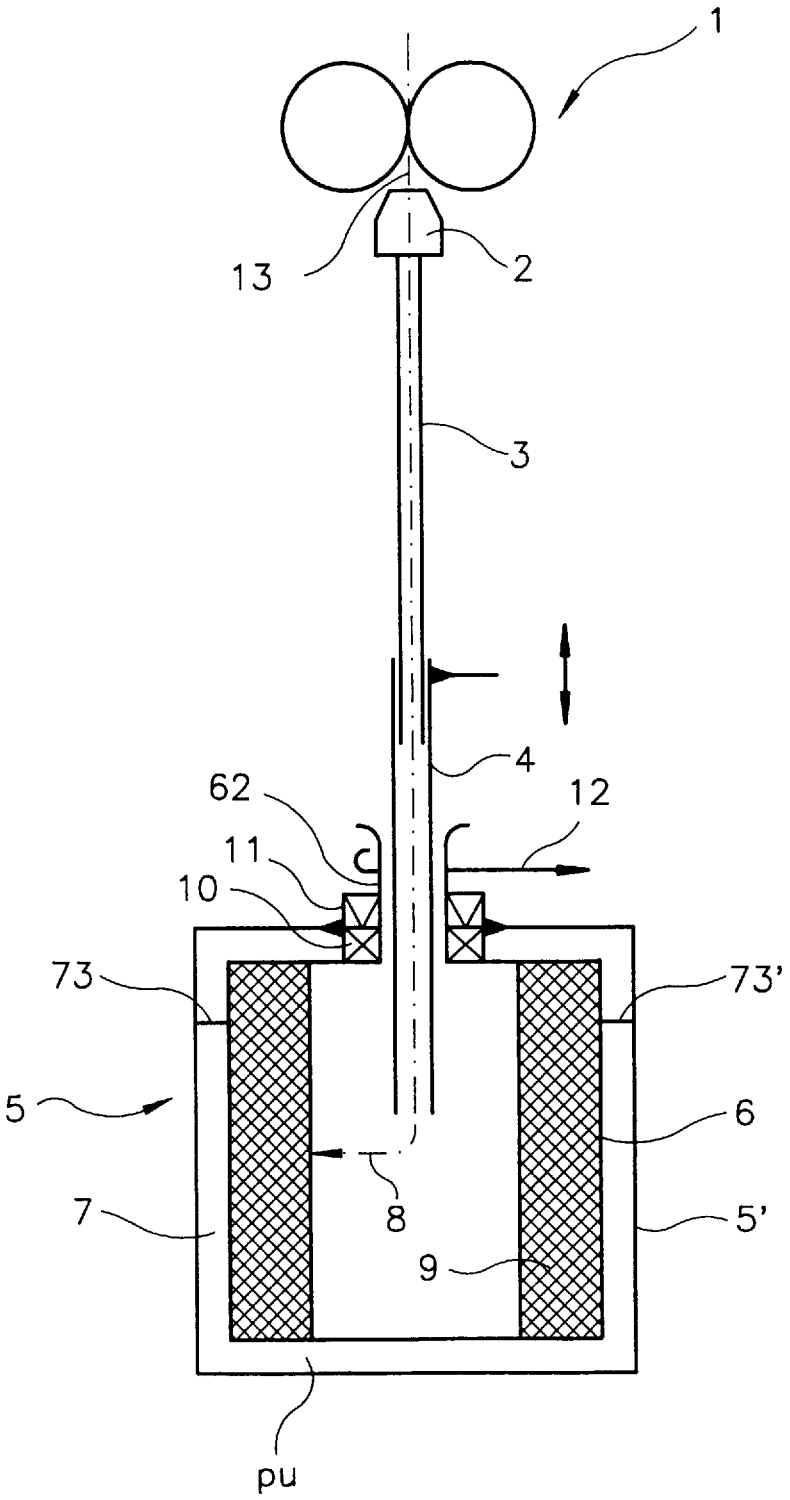
FIG. 1 is a schematic sectional view of a vacuum centrifugal pot spinning device according to the invention.

According to the present invention, there is provided for a device for the spinning of a yarn of classical character. A centrifuge 6, 35, 45, 53 in which a partially twisted yarn is spun in a first stage. The remaining twist is imparted to the yarn in a second stage upon removal while being wound up. A traversing thread guide tube 4 is disposed in the centrifuge. The centrifuge 6, 35, 45, 53 is positioned inside the housing 5', 21, 22, 31, 43, 50 so as to pivot. An internal space 7, 40, 48, 56 between the centrifuge and the housing can be placed under reduced pressure (pu), whereas normal air pressure (pn) prevails inside the centrifuge, whereby the reduced pressure (pu) is adjustable in such a way that, during rotation of the centrifuge, essentially only a bearing friction of the centrifuge still occurs but that an air friction of an outer wall of the centrifuge 6, 35, 45, 53 against the housing 5', 21, 22, 31, 43, 50 is largely suppressed.

The centrifuge 6, 35, 45, 53 can have a bottle-shaped design and can be equipped with a neck 62, 69, 70, 71 constructed centrically as a rotational axis. A diameter $d_h$ of the neck can be small relative to a diameter $d_z$ of the centrifuge 6, 35, 45, 53. Said neck can be sealed in an air-tight manner with respect to the housing 5', 21, 22, 31, 43, 50 in order to maintain the vacuum.

The housing 5', 31, 43, 50 and/or the centrifuge 6, 35, 45, 53 can consist of at least two parts 21, 22, 32, 33, 36, 37, 43, 44, 46, 47, 51, 52, 54, 55, which can be moved apart. One part of the centrifuge can be mounted axially so as to pivot in one part of the housing and the other part can be mounted axially so as to pivot in the other part of the housing.

The housing 43 can be constructed in a pot-like, openable fashion and can have a removable cover 44. The centrifuge 45 can have only one axis 62 and can be mounted with this axis inside the housing 43 in a pivoting and sealed manner. An electric motor 41' can be integrated into the housing, preferably around the axis 62.

The centrifuge parts 36, 37, 46, 47 of the centrifuge 35, 45 can fit into each other in a conical or telescoping manner. The expansion behaviors of the centrifuge parts under centrifugal force can be coordinated with one another by a suitable choice of materials as well as by suitable shaping of the centrifuge parts in such a way that, during rotation, a hermetically air-tight centrifuge results, which is capable of accommodating the axial forces arising under vacuum.

A first part of the centrifuge can be mounted so as to pivot with a fixed bearing and a second part of the centrifuge can be mounted so as to pivot with a movable bearing in a corresponding part of the housing. An auxiliary elevated pressure pü can be applied on a side of the movable bearing for the purpose of fitting the parts. Said pressure can be set to zero during a spinning phase.

The housing 31, 43 and/or the centrifuge can be mounted on springs so that the centrifuge is hung by means of a Cardan suspension and the gyroscopic axis is able to align itself freely.

A vacuum pump can be connected to the internal space 7, 40, 48, 56 between the housing 5', 31, 43, 50 and the centrifuge 6, 31, 45, 53.

A plunger 49 with a rotating plate 64 and an axis 65 can be associated with the centrifuge 45 and can have a channel 66 through which reduced pressure pu may be applied for suction attachment to a lower part of the centrifuge 47. The rotating plate 64 can be docked to the lower part of the centrifuge 64.

A sleeve-shaped or ring-shaped molded rubber part 58 can be positioned inside the housing 50 on a side of a fixed bearing. A centrifuge part 54 of a centrifuge 53 can be mounted within the housing in a pivoting and sealed manner. Each of the centrifuge parts 54, 55 can be equipped with a sealing thread or bayonet catch 61, 61' on the overlapping edges.

One housing part 51 of the housing 50 can have a braking device 60 disposed opposite the mounted, relatively mobile centrifuge part 54 of the centrifuge 53 for braking and stopping the associated centrifuge part 54. This centrifuge part 54 can be mounted so as to pivot, preferably by means of a fixed bearing 57, inside the associated housing part 51.

A doffer 23 can be disposed in a swivelable manner in the vicinity of the centrifuge. The doffer can consist of a mandrel 67 pivotably disposed at a mounting part 42. A sleeve 28 can be disposed at the mandrel 67.

A cutting and crimping device 27 for the thread 8 can be disposed in the vicinity of the upper dead center of the thread guide tube 4.

An axis of the drawing frame can be inclined at an angle $\alpha$, preferably up to an angle of 45 degrees, with respect to an axis of the thread guide tube.

FIG. 1 shows a schematic representation of a vacuum centrifugal pot spinning device 5 for carrying out the process. From a drawing frame 1, the emerging filament sliver 13 arrives in a piecing or twisting mechanism 2, with which the spinning is started automatically. The piecing or twisting mechanism 2 passes the yarn being formed through a thread conveying tube 3 into a thread guide tube 4, which traverses in a centrifuge 6 in the direction of the double arrow. In one-stage centrifugal pot spinning, the thread guide tube 4 lays down the yarn into a cross-wound cheese; in stagewise spinning, on the other hand, the thread guide tube 4 lays down the yarn in a kind of parallel winding.

The centrifuge 6 is mounted so as to pivot in a housing 5' by means of a bearing 10 in such a manner as to hang freely or to stand freely around a bottle-like neck 62 of the centrifuge 6; as a matter of principle, the housing can be opened in order to remove the centrifuge 6, which is indicated by the short separation lines 73, 73'. A neck 62 of the centrifuge 6 is hollow and, at the same time, forms the rotational axis of the centrifuge 6 and the inlet for the thread guide tube 4 into the centrifuge 6 which, for this reason, can be described as being preferably constructed in a bottle-shaped fashion. The internal space 7 between the outer wall of centrifuge 6 and the housing 5' is evacuated; a vacuum prevails there to the greatest extent possible, which is indicated by the designation "pu" in FIG. 1. Because of this, the neck 62 of the centrifuge 6 is appropriately sealed from the outside against the internal space 7 of housing 5' by means of a seal 11; normal air pressure, "pn", however, prevails inside the centrifuge 6. The neck 62 of the centrifuge 6 has a diameter $d_h$, which is relatively small with respect to the diameter $d_z$, of the centrifuge 6. The centrifuge 6 is operated by means of a whorl, which is indicated by the curved reference arrow 12.

The centrifuge 6 is filled when the internal diameter of the wound yarn 9 is about 40 mm. In pure centrifugal pot spinning, the rotational speed is then reduced to about 1/10, the reduced pressure is relieved, and the wound yarn 9 is removed from the housing 5' by opening the housing 5' or else the yarn can be wound out of the housing 5' without opening the housing 5' or the centrifuge 6.

Because the centrifugal pot spinning process allows very high rotational speeds, spinning can be carried out directly from the can 14, whereby the capital invested in a high-draft drawing frame 1 is well utilized. In spinning from the can 14, the conveyance of the sliver 13 to the drawing frame 1 is facilitated by positioning a false-twist mechanism 15 before the drawing frame 1. If thicker slivers 13 are to be processed, a sliver divider 16, which serves both drawing frames 1, 1', can be positioned between the false-twist mechanism 15 and the drawing frame 1, 1'.

Figure 2:
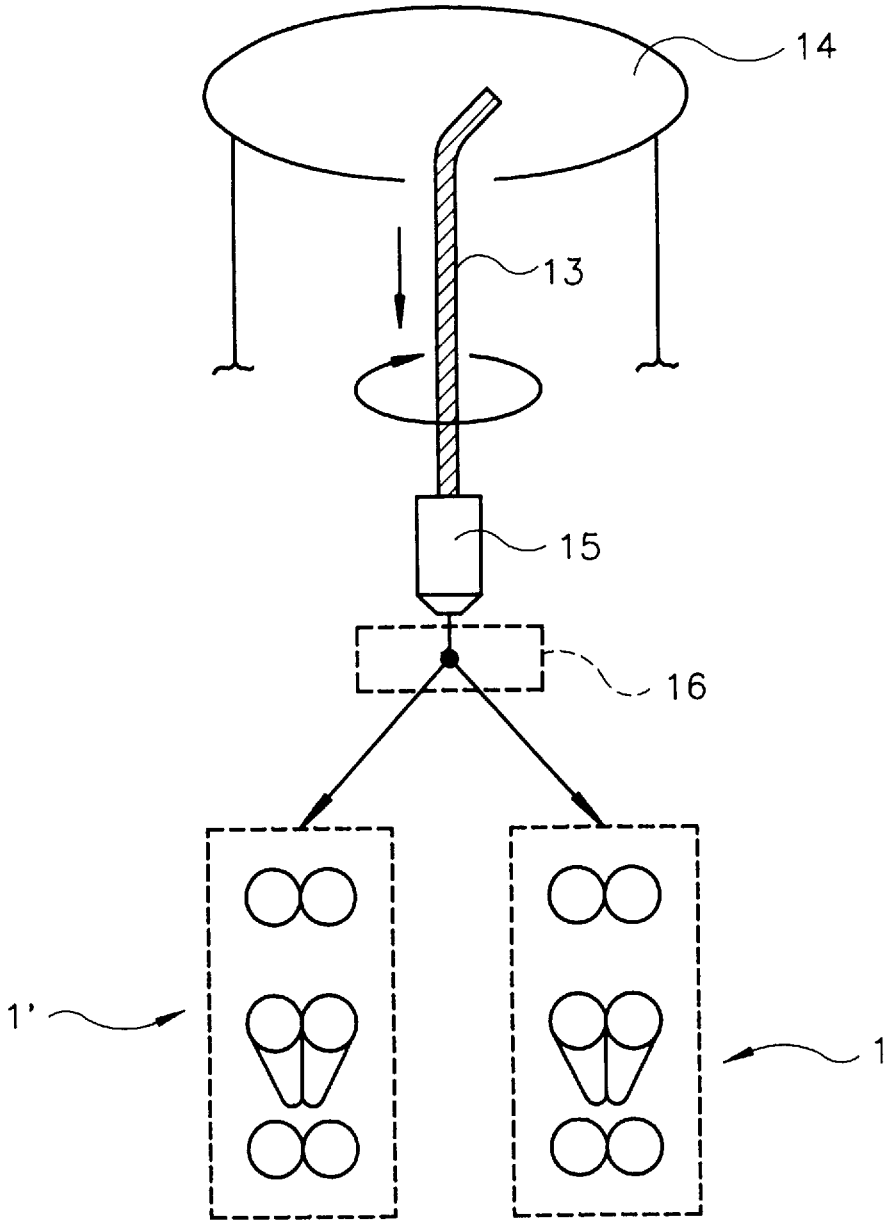
FIG. 2 is a view of a diagram of a spinning mechanism between drawing frame and can during spinning from the can.

FIG. 2 shows the spinning mechanisms, namely the false-twist mechanism 15 and the sliver divider 16, located between two drawing frames 1, 1' and the can 14. The former imparts false twists to sliver 13, thereby making possible a conveyance free of wrong draft. For relatively thick slivers 13, the latter distributes the slivers 13 emerging from the false-twist mechanism 15 to the two drawing frames 1, 1'.

Figure 3:
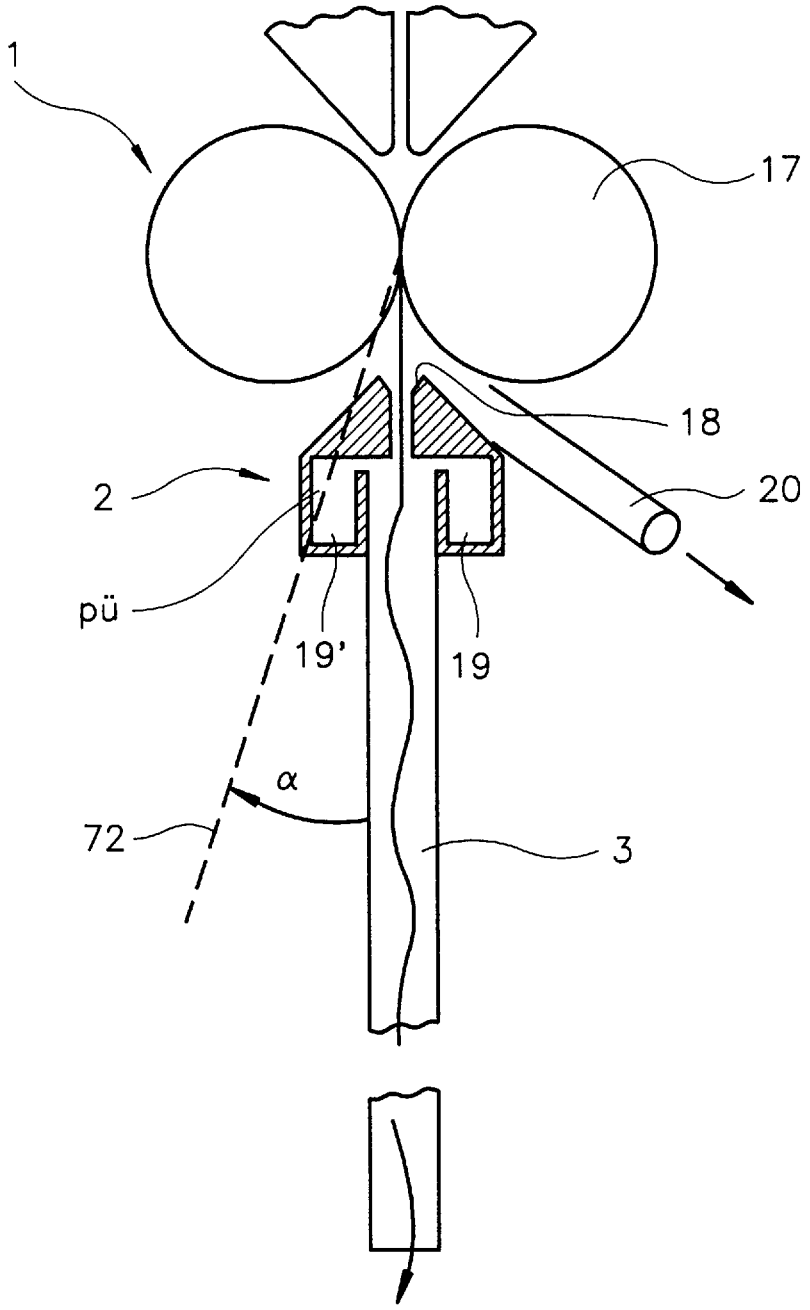
FIG. 3 is a schematic sectional view of a piecing mechanism with auxiliary suction channel.

FIG. 3 shows the drawing frame 1 and the piecing mechanism 2 in a cross-section. The delivery rolls 17 of drawing frame 1 lie opposite the suction channel 18 of the piecing mechanism 2, inside of which there are two air-filled tangential channels 19, 19'; in addition, an auxiliary suction channel 20 can be positioned near the mouth of the suction channel 18. When the yarn being formed has reached the wall of the centrifuge 6 through the thread conveying tube 3 and the thread guide tube 4, the auxiliary suction through the auxiliary suction channel 20, which is required for starting the spinning, is switched off.

The diameter of suction channel 18 is preferably less than 3 mm. Compressed air pü enters the thread conveying tube 3 through the channels 19, 19' and forms a vortex, in whose center reduced-pressure prevails. In this way, a filament sliver is sucked in and twisted, this process being supported by the auxiliary suction 20. The thread conveying tube 3 has a diameter preferably smaller than 6 mm and opens at the upper dead center of thread guide tube 4 into the latter.

Normally, the drawing frame axis 72 and the axis of the thread conveying tube 3 are aligned perpendicularly. However, the inclination of the drawing frame axis 72 can be continuously adjusted toward the axis of the thread conveying tube 3 up to an angle $\alpha$ of preferably 45 degrees; the pivotal point corresponds to the mid-point of the lower roll of the drawing frame 1. In this way it is possible to adjust the character of the yarn within certain limits. Through fine adjustment of the working mechanisms, optimal transmission of the spinning tension is achieved all the way to the crimping line of the drawing frame 1, whereby a chord-like laydown of the yarn in the centrifuge 6 is avoided.

Figure 4C:
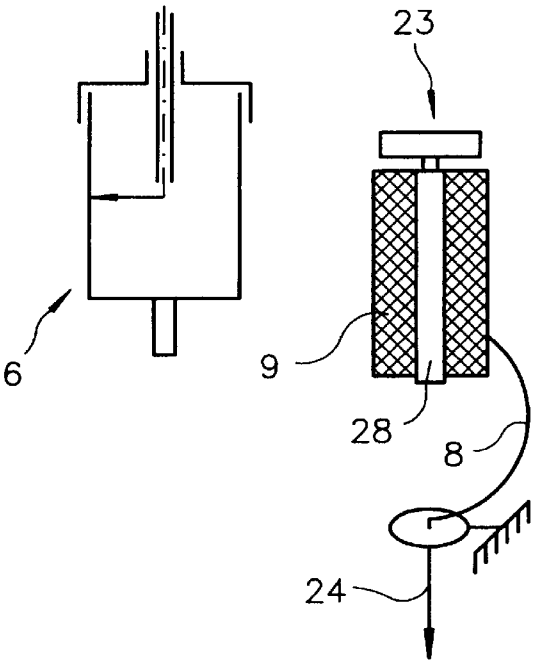
FIG. 4*c* shows a schematic view of a third stage of spinning.
Figure 4B:
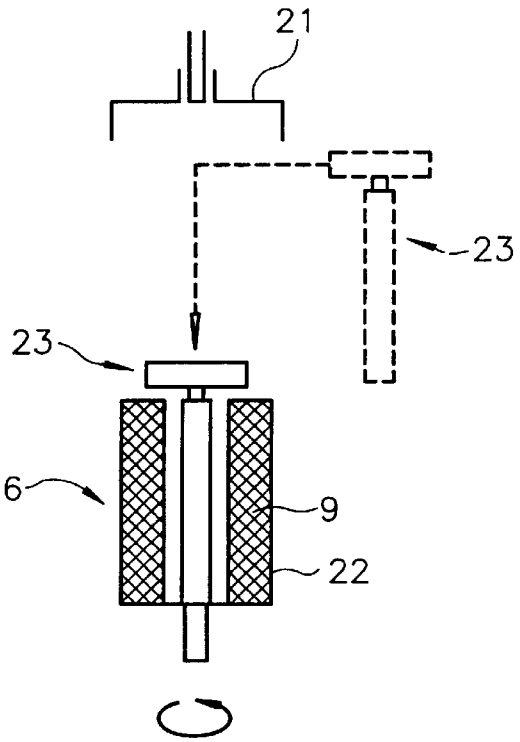
FIG. 4*b* shows a schematic view of a second stage of spinning.
Figure 4A:
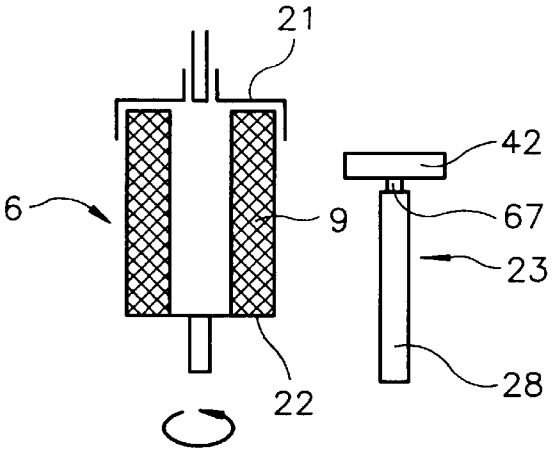
FIG. 4*a* shows a schematic view of a first stage of spinning.

FIGS. 4*a* to 4*c* show the steps in the process of pure centrifugal pot spinning. The centrifuge 6 consists of two parts, namely, an upper part 21 and a lower part 22 with the wound yarn 9 in the interior. Associated with this is a doffer 23 consisting of a mounting part 42, which can be suitably fastened to the machinery and which has a rotating mandrel 67 to which a sleeve 28 is attached so as to pivot and where the sleeve 28 is capable of holding the wound yarn 9.

In accordance with FIG. 4*b*, the centrifuge 6 is moved apart while a rotational speed of 1/10 of the operating rotational speed is maintained, so that the doffer 23 can be inserted into the wound yarn 9.

After the sleeve 28 of the doffer 23 has been put into place and set in rotation by the rotating lower part 22 of the centrifuge 6, the rotational speed is set to zero, whereby the wound yarn 9 collapses onto sleeve 28. The wound yarn 9 is removed and can be rewound overhead from the sleeve 28, which is indicated in FIG. 4*c* by reference arrow 24, which pulls off thread 8. The centrifuge 6 is then closed and continues to spin.

Figure 4E:
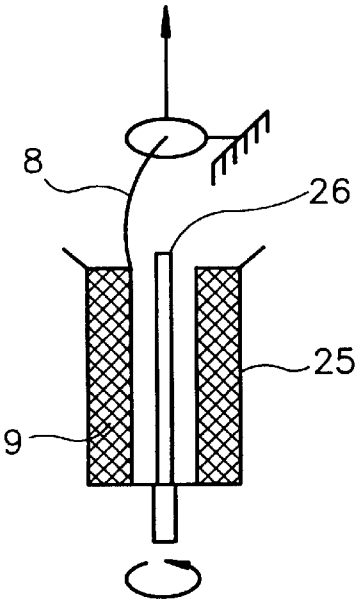
FIG. 4*e* shows a schematic view of a fifth stage of spinning.
Figure 4D:
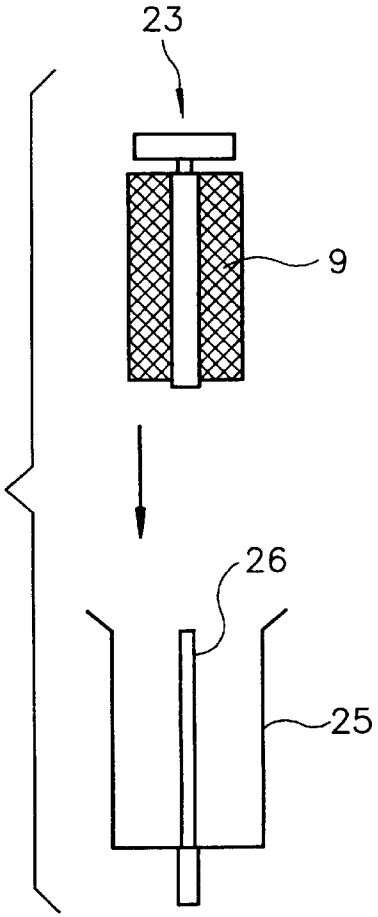
FIG. 4*d* shows a schematic view of a fourth stage of spinning.

Extremely high rewinding speeds become possible when the wound yarn 9 is transferred to an auxiliary centrifuge 25 with a central mandrel 26 in accordance with FIG. 4*d*. After transfer of the wound yarn to the stationary auxiliary centrifuge 25, the stationary auxiliary centrifuge 25 is accelerated to about 10,000 rpm. In accordance with FIG. 4*e*, the thread or yarn 8 can be rewound overhead from the inside to the outside with additional twist being imparted. In this way, several additional twists per meter are imparted to the yarn if winding is carried out at over 2,000 m/min. Consideration of the entire process reveals that it once again involves a stagewise spinning process.

Figure 5:
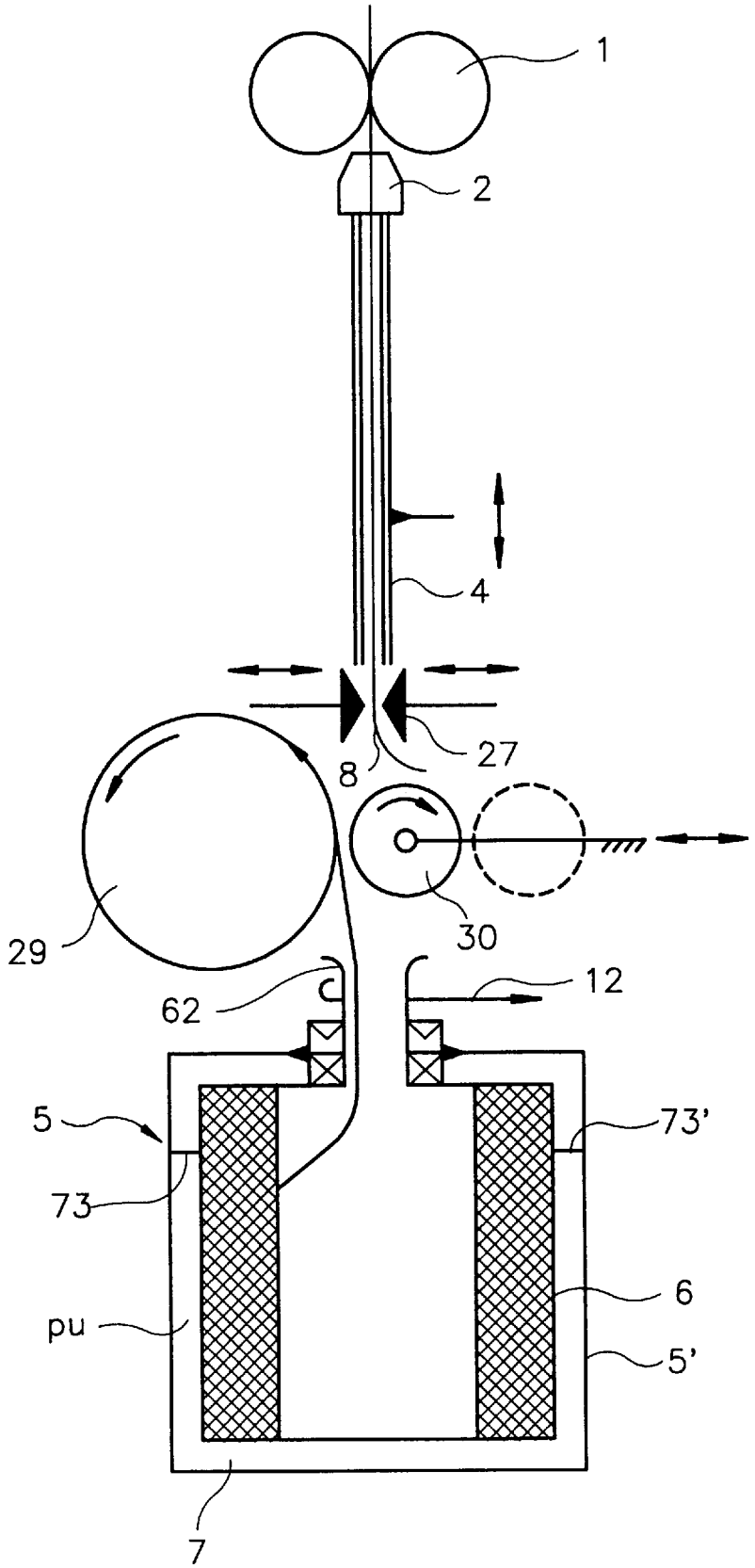
FIG. 5 shows a schematic sectional view of a vacuum centrifugal pot spinning device for stagewise spinning with a cutting and crimping device.

If the stagewise spinning process is used, the yarn can be pulled out of the centrifuge 6 once the centrifuge is filled, with further twist being imparted, and the yarn can be wound onto a bobbin 30 that is located in the immediate vicinity of the centrifuge 6, as shown in FIG. 5. In this process, it has proven advantageous in two-stage centrifugal pot spinning to give the yarn at least 90 percent, preferably 95 percent, of the twist in the first stage and to impart the remaining twist in the second stage.

Between the thread guide tube 4 and the housing 5' of a vacuum centrifugal pot spinning device 5, similar to that in FIG. 1, there is a cutting and crimping device 27 and a wind-up device 29. After the centrifuge 6 is filled, the thread guide tube 4 reaches its highest point. The yarn 8 is affixed by the cutting and crimping device 27 and thrown by means of an auxiliary roll 30 onto the wind-up device 29 where it is wound up, after which the operating sequence is repeated. The cutting and crimping device 27 can be moved in the direction of the double arrow in FIG. 5 and ensures a clean separation of the yarn 8.

Figure 6:
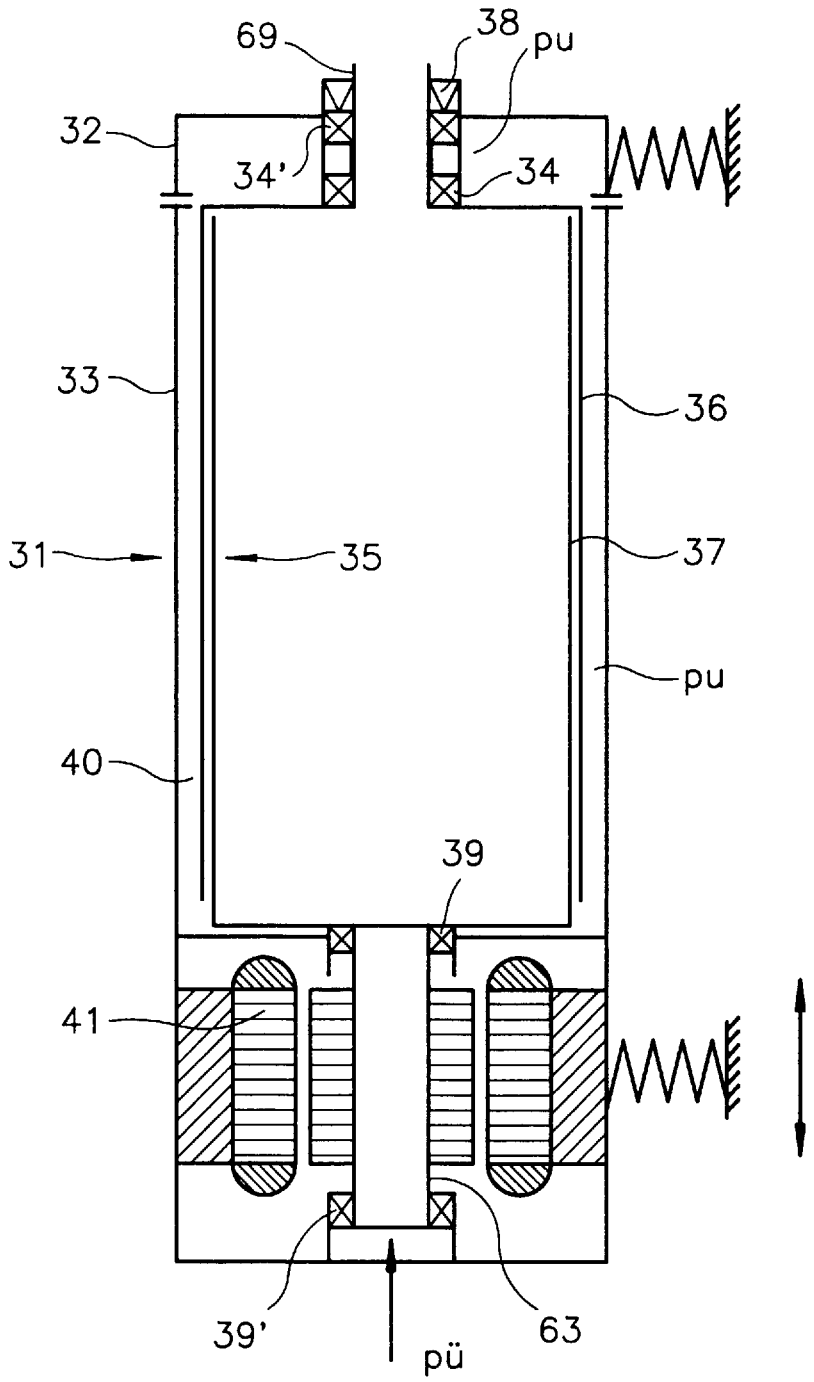
FIG. 6 shows a schematic sectional view of a first embodiment of a vacuum centrifugal pot spinning device for pure centrifugal pot spinning hung by means of a Cardan suspension.

A preferred embodiment of a vacuum centrifugal pot spinning device, preferably for pure centrifugal pot spinning, is represented in FIG. 6. Centrifuges for pure centrifugal pot spinning have a capacity of about 100 grams of yarn.

The vacuum centrifugal pot spinning device consists of a two-part housing 31. A bottle-shaped centrifuge 35 is positioned inside the two-part housing 31. Reduced pressure pu prevails in the space 40 between the housing 31 and the centrifuge 35. Normal pressure pn prevails in the interior of the centrifuge 35.

As a matter of principle, the centrifuge 35 can consist of at least two parts which fit into each other in a telescopic manner or are shaped somewhat conically, whereby the expansion behavior of the centrifuge parts under centrifugal force are coordinated by a suitable choice of materials as well as by a suitable shaping of the centrifuge parts in such a way that a hermetically sealed centrifuge results during the rotation of the two telescoping parts of the centrifuge 35. In addition, the parts can be pressed against each other by axially applied compressed air. One of the centrifuge parts can be mounted so as to pivot in one part of the housing 31, and the other of the centrifuge parts can be mounted in the other part of the housing 31, whereby a drive motor 41 is associated with one of the centrifuge parts. In order to fit the parts of the centrifuge 35 in a force-locking manner, the centrifuge 35 is accelerated to an intermediate rotational speed that is chosen to be so high that the two parts of the centrifuge 35 are compressed against each other in an air-tight manner owing to their different expansions. The inside part of the centrifuge 35 hereby expands under the centrifugal forces, so that the centrifuge 35 forms an air-tight system and the space between the housing 31 and the centrifuge 35 is then evacuated until a vacuum pu is attained. Subsequently, the rotational speed of the centrifuge 35 is accelerated until it reaches its operating rotational speed. The compression is thus chosen to be so high that it is accommodated by the axial forces due to the subsequently applied reduced pressure.

The housing 31 as well as the centrifuge 35 each consist of two parts 32, 33 and 36, 37, respectively, whereby the upper, outer part 36 of the centrifuge 35 is mounted in the upper part 32 of the housing 31, by means of an axial fixed bearing 34, 34'. An axial seal 38 seals the upper part 36 of the centrifuge 35 or the centrifuge neck 69 in an air-tight manner with respect to housing 31. The lower, inner part 37 of the centrifuge 35, which accommodates the wound yarn 9, is mounted in the lower part 33 of the housing 31 by means of an axial movable bearing 39, 39'. The lower, inner part 37 and the axially movable bearing 39, 39' together can be moved apart from the upper part 32 of the housing 31 and the upper part 36 of the centrifuge 35. The lower part 33 of the housing 31 accommodates an electric motor 41 which drives the lower part 37 of the centrifuge 35. The bearings 39, 39' move only under the load of gyroscopic forces; the entire system is mounted on springs, so that, basically, a free gyroscope is present.

The upper, outer part 36 and the lower, inner part 37 of the centrifuge 35 fit into each other and seal hermetically during rotation. In order to securely match up the upper, outer part 36 and the lower, inner part 37 of the centrifuge 35, an elevated pressure pü can be applied axially from the outside on the lower part 33 of the housing 31, thereby pressing together the upper, outer part 36 and the lower, inner part 37 which are movable with respect to each other. The elevated pressure is set to zero when the centrifuge starts to rotate; the materials and dimensions of the upper, outer part 36 and the lower, inner part 37 of the centrifuge 35 are coordinated with one another in such a fashion that, as the centrifugal force builds up, the result is a force-locked air-tight connection between the jacket walls of the upper, outer part 36 and the lower, inner part 37 of the centrifuge 35. When the centrifuge 35 has attained a minimum rotational speed and the upper, outer part 36 and the lower, inner part 37 of the centrifuge 35 are telescoped into each other, the space 40 is evacuated; then the centrifuge 35 inside the housing 31 reaches its operating rotational speed.

Figure 7:
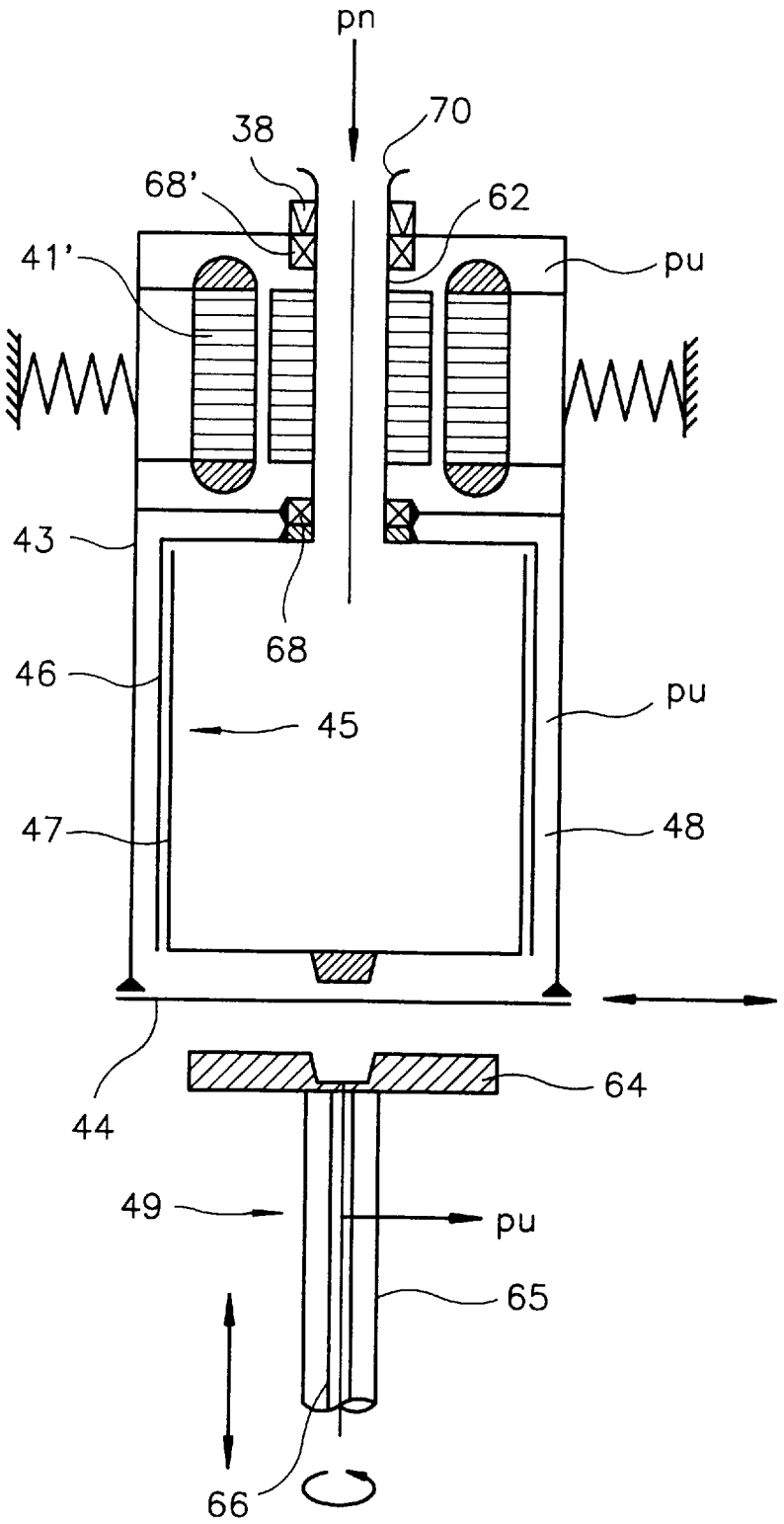
FIG. 7 shows a schematic sectional view of a second embodiment of a vacuum centrifugal pot spinning device hung by means of a Cardan suspension, preferably for stepwise spinning.

FIG. 7 illustrates a preferred embodiment of a vacuum centrifugal pot spinning device for two-stage spinning in which the yarn is laid down in parallel windings and which normally has a capacity of at least 50 grams of yarn. Situated inside a housing 43, which is constructed in a pot-like fashion, there is a centrifuge 45 having only one axis 62; similarly to the centrifuge 35 in FIG. 6, the centrifuge 35 consists of two centrifuge parts 46 and 47, whereby the upper, outer part 46 of the centrifuge 45 or the centrifuge neck 47 is mounted so as to pivot inside the housing 43 by means of a fixed bearing 68, 68' and is sealed in an air-tight manner against the outside by means of a seal 38. An electric motor 41' is once again an integral component of housing the 43 and of the upper part 46 of the centrifuge 45, and is thus advantageously arranged here in the vacuum. The housing 43 is mounted in a swinging fashion, so that the centrifuge 45 is hung by means of a Cardan suspension. At the opposite end, the housing 43 can be sealed in an air-tight, openable manner by means of a removable cover 44, which is indicated by the double arrow. The lower, inner part 47 of the centrifuge 45 sticks cup-like into the upper, outer part 46 of the centrifuge 45; the space 48 between the housing 43, the cover 44, and the centrifuge 45 can once again be evacuated.

This vacuum centrifugal pot spinning device, into which yarn is spun and out of which yarn is spun out, only needs to be opened when the rest of a yarn package has to be removed because of thread breakage. In such a case, the cover 44 is moved aside and the housing 43 is opened. A plunger 49 can be attached through reduced pressure pu to the bottom of the lower, that is the lower, inner part 47 of the centrifuge 45 and it can be pulled out of the upper, that is the upper, outer part 46 of the centrifuge 45.

If the plunger 49 is designed so as to rotate, the yarn package can still be removed in an orderly state because, owing to the residual centrifugal force, it remains on the wall of the lower, inner part 47 of the centrifuge 45. In the case of pure centrifugal pot spinning, on the other hand, it is possible to continue to spin despite thread breakage.

In all of the preceding examples, it is possible to proceed in such a way that a centrifuge part hangs on each part of the housing and the parts of the centrifuge can be force-locked together by applying elevated pressure. As soon as the centrifuge is started up, it closes so as to be hermetically sealed. The elevated pressure is then set to zero and, at a sufficient rotational speed, the space between the housing and the centrifuge is evacuated until practically a vacuum is attained. No forces act on the bearings of the centrifuge, because one of the bearings is constructed as a fixed bearing and the other as a movable bearing; the centrifuge is hung by means of a Cardan suspension.

Figure 8:
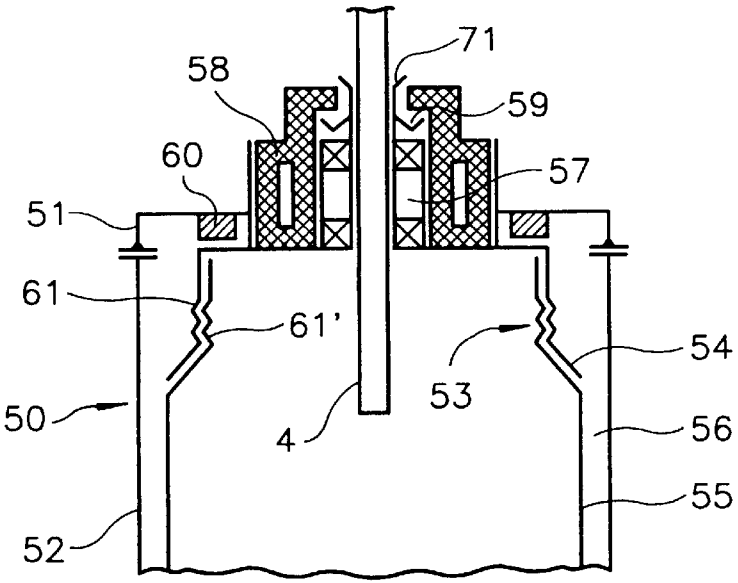
FIG. 8 shows a schematic sectional view of a third embodiment of a vacuum centrifugal pot spinning device hung by means of a Cardan suspension.

FIG. 8 shows another embodiment of a vacuum centrifugal pot spinning device. Positioned inside a housing 50, which can consist of two parts 51, 52, there is a centrifuge 53, which consists of two parts 54, 55; the space 56 between the housing 50 and the centrifuge 53 can be evacuated until practically a vacuum is attained. The upper, outer part 54 of the centrifuge 53 in the upper part 51 of the housing 50 has a bearing 57, which is mounted flexibly in a molded rubber part 58 for purposes of creating a Cardan suspension and which is sealed against the molded rubber part 58 in an air-tight manner from the outside by means of a seal 59 against the centrifuge neck 71. The upper part 51 of the housing 50 also has a braking device 60.

The lower, inner part 55 of the centrifuge 53 is suitably mounted and driven at its lower end, which is not shown. It can be removed in the axial direction—similarly to the centrifuges 35 and 45 in FIGS. 6 and 7—from the upper part 54 of the centrifuge 53 so that a yarn package or remaining yarn can be removed from the lower, inner part 55 of the centrifuge 53 in stagewise spinning.

A force-locking and/or positive-locking between the upper, outer part 54 and the lower, inner part 55 of the centrifuge 53 is achieved by making the outer edges or ends of the upper, outer part 54, and the lower, inner part 55 fit into each other conically or by equipping them with threads 61, 61' or bayonet catches, so that the ends of the upper, outer part 54 and the lower, inner part 55 suitably interlock in accordance with FIG. 8. In order to produce a connection between the upper, outer part 54 and the lower, inner part 55 of the centrifuge 53, the upper, outer part 54 is prevented from rotating by means of a brake 60, whereby the lower, inner part 55 of the centrifuge 53 is moved axially while rotating against the upper part 54 of the centrifuge 53 so that a closing of the centrifuge 53 occurs.

The opening of the centrifuge 53 occurs in the reverse sequence, whereby the centrifuge 53 is stopped and the upper part 54 of centrifuge 53 is blocked by means of a brake 60; the motor then runs briefly in the opposite direction, so that the upper, outer part 54 and the lower, inner part 55 of the centrifuge 53 separate and the wound-up yarn, situated in the interior of the centrifuge 53 shrinks. After the upper, outer part 54 and the lower, inner part 55 of the centrifuge 53 have been moved apart, the lower part 55 of the centrifuge 53 is set in rotation separately by means of a motor, whereby the wound yarn opens and becomes stiff, so that a doffer can be inserted and the yarn can be removed.

Basically, one of the parts of the housing can have a braking device disposed opposite to the mounted, relatively mobile part of the centrifuge for braking and stopping the associated part of the centrifuge. This part of the centrifuge is mounted so as to pivot, preferably by means of a fixed bearing inside the associated part of the housing.

The doffer can be suitably positioned on the machinery of the vacuum centrifugal pot spinning device; for example, it can be automatically inserted into the part of the centrifuge holding the wound yarn after the two parts of the centrifuge have been moved apart.

The vacuum centrifugal pot spinning process and the vacuum centrifugal pot spinning device are especially suited for the production of yarns of classical character, whereby it is possible to spin with a specifically lower energy and thus capital input than is possible for state-of-the-art ring and rotor spinning devices. The specific energy and capital requirement, based on a yarn of the same strength and fineness, lies below those of state-of-the-art ring and rotor spinning.

It will be understood that each of the elements described above, or two or more together, may also find a useful application in other types of a spinning process and a device for said spinning process END differing from the types described above.

While the invention has been illustrated and described as embodied in the context of a centrifugal pot spinning process and a device for performing said process, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A centrifugal pot spinning process for spinning yarn comprising the steps:

placing a centrifuge (6, 35, 45, 53) in a container (7, 40, 48, 56);

reducing a pressure (pu) in the container to below atmospheric pressure;

maintaining standard ambient air pressure inside the centrifuge;

rotating the centrifuge (6, 35, 45, 53) in the container (7, 40, 48, 56) under reduced pressure (pu), while standard ambient air pressure (pn) prevails inside the centrifuge;

spinning yarn in the centrifuge under standard ambient air pressure (pn);

adjusting the reduced pressure (pu) in the container during rotation of the centrifuge in such a way that the air friction of the outer wall of the centrifuge (6, 35, 45, 53) is largely suppressed.

2. The centrifugal pot spinning process for spinning yarn according to claim 1, wherein the spinning to a fully twisted yarn is performed in one single step.

3. The centrifugal pot spinning process according to claim 2, further comprising dropping a rotational speed considerably below a nominal rotational speed after the centrifuge (6, 35, 45, 53) is filled with spun yarn;

relieving the reduced pressure (pu); and removing the wound yarn (9) with the help of a doffer (23).

4. The centrifugal pot spinning process according to claim 3, wherein the dropping of the rotational speed amounts to about 1/10 of the nominal rotational speed.

5. The centrifugal pot spinning process for spinning yarn according to claim 1, wherein the yarn is spun to a partially twisted yarn in the centrifuge (6, 35, 45, 53) in a first stage; further comprising removing the partially twisted yarn from the centrifuge (6, 35, 45, 53);

imparting a remaining twist to the partially twisted yarn in a second stage upon removal while being wound by using the centrifuge, a drawing frame (1, 1'), a piecing mechanism (2), and a traversing thread guide tube (4) in connection with the centrifuge.

6. The centrifugal pot spinning process for spinning yarn according to claim 1, further comprising reducing the pressure of ambient gas and thereby the air friction of the rotating centrifuge for leaving thereby essentially only a bearing friction of a bearing of the centrifuge as generating friction to the centrifuge during rotation.

7. The centrifugal pot spinning process according to claim 1 wherein the air is suctioned off immediately above a piecing mechanism (2) for starting the spinning, wherein the spinning starts automatically and wherein the suction of the air (20) is stopped as soon as the yarn being formed has reached a wall of the centrifuge (6, 35, 45, 53).

8. The centrifugal pot spinning process according to claim 1, further comprising stopping the running of the centrifuge disposed in a housing; shrinking the wound yarn situated in the interior of the centrifuge; collapsing the yarn onto a sleeve of a doffer; removing the wound yarn from the sleeve.

9. The centrifugal pot spinning process according to claim 1, further comprising imparting about 90 percent of the twist to the yarn in a first stage of the spinning; and imparting the remaining twist in a second stage of the spinning.

10. The centrifugal pot spinning process according to claim 1, wherein the spinning occurs from a can (14);

further comprising imparting a false twist to the sliver (13) between an outlet of the can and an inlet of a drawing frame (1, 1') by means of a false-twist mechanism (15).

11. The centrifugal pot spinning according to claim 10, further comprising dividing the sliver (13) after the false-twist mechanism (15) and feeding the sliver to two drawing frames (1, 1').

12. The centrifugal pot spinning process according to claim 1, using a housing and wherein the centrifuge rotates in the housing under vacuum, wherein the housing consists of at least two parts of the housing, wherein the centrifuge consists of at least two parts of the centrifuge and wherein said parts of the centrifuge telescope into each other, and wherein the parts of the centrifuge have different expansions, comprising the following steps in order to fit the parts of the centrifuge in a force-locking manner, accelerating the centrifuge to an intermediate rotational speed that is chosen to be so high that the two parts of the centrifuge are compressed against each other in an air-tight manner owing to their different expansions, whereby the compression is chosen to be so high that it is accommodated by the axial forces caused by the subsequently applied reduced pressure (pu); and subsequently accelerating the centrifuge to the operating rotational speed.

13. A device for the spinning of a yarn with a centrifuge (6, 35, 45, 53) comprising a housing;

a centrifuge (6, 35, 45, 53) positioned so as to pivot inside the housing (5', 21, 22, 31, 43, 50), wherein an internal space (7, 40, 48, 56) between the centrifuge and the housing is placed under reduced pressure (pu) as compared to the atmospheric pressure inside the centrifuge while normal air pressure (pn) is maintained inside the centrifuge;

a bearing supporting the centrifuge;

adjustment means for the reduced pressure, wherein the reduced pressure is adjustable in such a way that, during rotation of the centrifuge, essentially only a bearing friction of the bearing still occurs but wherein an air friction of an outer wall of the centrifuge (6, 35, 45, 53) against the housing (5', 21, 22, 31, 43, 50) is largely suppressed for spinning and removing a fully twisted yarn in one stage;

a thread guide tube (4) traversing into the centrifuge:

a thread conveying tube (3) placed into the thread guide tube (4);

a piecing mechanism (2), wherein the thread conveying tube (3) is disposed at the piecing mechanism (2);

a drawing frame (1, 1') disposed at the piecing mechanism (2).

14. A device for the spinning of a yarn comprising a drawing frame (1, 1');

a piecing mechanism (2) disposed at the drawing frame (1, 1');

a thread conveying tube (3) attached at the piecing mechanism (2);

a thread guide tube (4) receiving the thread conveying tube (3);

a housing;

a centrifuge (6, 35, 45, 53) in which a partially twisted yarn is spun in a first stage, and wherein the remaining twist is imparted to the yarn in a second stage upon removal while being wound up;

a bearing supporting the centrifuge;

wherein the thread guide tube (4) traverses into the centrifuge, wherein the centrifuge (6, 35, 45, 53) is positioned inside the housing (5', 21, 22, 31, 43, 50) so as to pivot, and wherein an internal space (7, 40, 48, 56) between the centrifuge and the housing is placed under reduced pressure (pu), whereas normal air pressure (pn) prevails inside the centrifuge, whereby the reduced pressure (pu) is adjustable in such a way that, during rotation of the centrifuge, essentially only a bearing friction of the bearing still occurs but wherein an air friction of an outer wall of the centrifuge (6, 35, 45, 53) against the housing (5', 21, 22, 31, 43, 50) is largely suppressed.

15. The device according to claim 14, wherein the centrifuge (6, 35, 45, 53) has a bottle-shaped design and is equipped with a neck (62, 69, 70, 71) constructed centrically as a rotational axis, wherein a diameter ($d_h$) of the neck is small relative to a diameter ($d_z$) of the centrifuge (6, 35, 45, 53) and which neck is sealed in an air-tight manner with respect to the housing (5', 21, 22, 31, 43, 50) in order to maintain a vacuum.

16. The device according to claim 14, wherein at least one of the housing (5', 31, 43, 50) and the centrifuge (6, 35, 45, 53) consist of at least two parts (21, 22, 32, 33, 36, 37, 43, 44, 46, 47, 51, 52, 54, 55), which are moved apart, whereby one part of the centrifuge is mounted axially so as to pivot in one part of the housing and the other part is mounted axially so as to pivot in the other part of the housing.

17. The device according to claim 14, wherein the housing (43) is constructed in a pot-like, openable fashion and has a removable cover (44), whereby the centrifuge (45) has only one axis (62) and is mounted with this axis inside the housing (43) in a pivoting and sealed manner and an electric motor (41') is integrated into the housing, preferably around the axis (62).

18. The device according to claim 14, wherein centrifuge parts (36, 37, 46, 47) of the centrifuge (35, 45) fit into each other in a conical or telescoping manner, whereby the expansion behaviors of the centrifuge parts under centrifugal force are coordinated with one another by a suitable choice of materials as well as by suitable shaping of the centrifuge parts in such a way that, during rotation, a hermetically air-tight centrifuge results, which is capable of accommodating the axial forces arising under vacuum.

19. The device according to claim 14, wherein a first part of the centrifuge is mounted so as to pivot with a fixed bearing and a second part of the centrifuge is mounted so as to pivot with a movable bearing in a corresponding part of the housing, whereby an auxiliary elevated pressure (pü) is applied on a side of the movable bearing for the purpose of fitting the parts, and wherein said pressure is set to zero during a spinning phase.

20. The device according to claim 14, wherein at least one of the housing (31, 43) and the centrifuge are mounted on springs so that the centrifuge is hung by means of a Cardan suspension and the gyroscopic axis is able to align itself freely.

21. The device according to claim 14, wherein a vacuum pump is connected to the internal space (7, 40, 48, 56) between the housing (5', 31, 43, 50) and the centrifuge (6, 31, 45, 53).

22. The device according to claim 14, wherein a plunger (49) with a rotating plate (64) and an axis (65) is associated with the centrifuge (45) and has a channel (66) through which reduced pressure (pu) is applied for suction attachment to a lower part (47) of the centrifuge, whereby the rotating plate (64) is docked to the lower part (47) of the centrifuge.

23. The device according to claim 14, wherein a sleeve-shaped or ring-shaped molded rubber part (58) is positioned inside the housing (50) on a side of a fixed bearing, wherein a centrifuge part (54) of the centrifuge (53) is mounted within the housing in a pivoting and sealed manner, whereby each of the centrifuge parts (54, 55) is equipped with a sealing thread or bayonet catch (61, 61') on the overlapping edges.

24. The device according to claim 14, wherein one housing part (51) of the housing (50) has a braking device (60) disposed opposite the mounted, relatively mobile centrifuge part (54) of the centrifuge (53) for braking and stopping the associated centrifuge part (54), whereby this centrifuge part (54) is mounted so as to pivot, preferably by means of a fixed bearing (57), inside the associated housing part (51).

25. The device according to claim 14, wherein a doffer (23) is disposed in a swivelable manner in the vicinity of the centrifuge, wherein the doffer consists of a mandrel (67) pivotably disposed at a mounting part (42), and wherein a sleeve (28) is disposed at the mandrel (67).

26. The device according to claim 14, wherein a cutting and crimping device (27) for the thread (8) is disposed in the vicinity of an upper dead center of the thread guide tube (4).

27. The device according to claim 14, wherein an axis of the drawing frame is inclined at an angle ($\alpha$), preferably up to an angle of 45 degrees, with respect to an axis of the thread guide tube.

28. A centrifugal pot spinning process for spinning yarn in which either in one stage a fully twisted yarn or in a first stage a partially twisted yarn is spun in a centrifuge (6, 35, 45, 53) and removed from it and, in the case of the partially twisted yarn, the remaining twist is imparted in a second stage upon removal while being wound up, whereby the centrifuge, a drawing frame (1, 1'), a piecing mechanism (2), and a traversing thread guide tube (4) in the centrifuge are used, wherein the centrifuge (6, 35, 45, 53) rotates in a space (7, 40, 48, 56) under reduced pressure (pu) below atmospheric pressure, whereas normal air pressure (pn) prevails inside the centrifuge and the spinning is carried out in the centrifuge under normal air pressure (pn), whereby the reduced pressure (pu) is adjusted in such a way that, during rotation of the centrifuge, essentially only the bearing friction of the centrifuge still occurs but the air friction of the outer wall of the centrifuge (6, 35, 45, 53) is largely suppressed.

29. The centrifugal pot spinning process according to claim 28, further comprising:

transferring the yarn to a stationary auxiliary centrifuge;

accelerating the stationary auxiliary centrifuge; and rewinding the yarn overhead from the inside outside.

* * * * *